United States Patent [19]

Ihle

[11] 4,144,731

[45] Mar. 20, 1979

[54] MACHINE FOR FLATTENING SHEET METAL

[75] Inventor: Josef Ihle, Pforzheim, Fed. Rep. of Germany

[73] Assignee: Irma Ungerer geb. Dollinger, Pforzheim, Fed. Rep. of Germany

[21] Appl. No.: 839,425

[22] Filed: Oct. 5, 1977

[30] Foreign Application Priority Data

Apr. 16, 1977 [DE] Fed. Rep. of Germany ..... 2716921

[51] Int. Cl.[2] ..... B21D 1/02

[52] U.S. Cl. ..... 72/165

[58] Field of Search ..... 72/165, 164, 163, 160

[56] References Cited

U.S. PATENT DOCUMENTS

| | | | |
|---|---|---|---|
| 1,959,492 | 5/1934 | Moses | 72/165 |
| 2,009,508 | 7/1935 | Maussnest | 72/165 X |
| 2,827,945 | 3/1958 | Maust | 72/163 X |
| 3,477,266 | 11/1969 | Fornataro | 72/165 |
| 3,606,784 | 9/1971 | Schluter | 72/165 |

FOREIGN PATENT DOCUMENTS

| | | | |
|---|---|---|---|
| 631997 | 7/1936 | Fed. Rep. of Germany | 72/163 |

*Primary Examiner*—Milton S. Mehr

[57] ABSTRACT

A plurality of horizontal lower rolls are rotatably mounted in a machine frame. A plurality of nuts are carried by the machine frame and axially retained and rotatable on respective vertical axes, which are horizontally spaced apart in the longitudinal direction of said lower rolls and in a direction which is transverse to said longitudinal direction. A plurality of screws are in threaded engagement with respective ones of said nuts. A plurality of upwardly and downwardly convex spherical bearings are carried by respective ones of said screws above said nuts. An upper yoke assembly comprises an upper yoke member, a plurality of upper rolls rotatably mounted in said upper yoke member and disposed above said upper rolls and defining nips therewith, and a plurality of concave spherical bearings, which are rigid with said upper yoke member and each of which has upwardly and downwardly concave bearing faces respectively disposed below and above one of said convex bearings and engagable therewith. Spring means are provided, which urge said concave bearings upwardly relative to said convex bearings, and actuating means for rotating said nuts relative to said screws.

8 Claims, 3 Drawing Figures

3
7
7
6
8
16
9
17
2
11
18
4
10
16
8
17
9
12
11
18
5
10a
10
13
10b
1
15
14

MACHINE FOR FLATTENING SHEET METAL

This invention relates to a machine for flattening sheet metal or strip metal, comprising double screws for axially and angularly adjusting a yoke, which carries upper rolls.

Such a machine has been disclosed in U.S. Pat. Application Ser. No. 799,074 filed May 20, 1977, now patent No. 4,089,197. In the machine according to that prior application, the screws are adjustable jointly or in pairs by means of nuts threaded on the screws and mounted in the crosshead and connected to respective worm wheels, and the yoke is suspended by spring-loaded spherical bearings from the lower end of respective screws whereas arcuate guides are omitted.

It is an object of the present invention to provide a machine which is simpler in design and permits of a precise control of the flattening action by a vertical adjustment and by angular adjustments on horizontal axes which extend in the direction of travel of the strip and transversely thereto so that the flattening effect can be more precisely controlled by such adjustments.

A further object of the present invention resides in that the flattening machine should be as rigid as possible and for that purpose the flattening forces should be transmitted to the foundation of the machine as directly as possible rather than by side frame members.

In a machine for flattening sheet metal or strip metal, comprising double screws, which serve to axially adjust a yoke, which carries upper rolls, and which screws are adjustable jointly or in pairs by means of nuts threaded on the screws and connected to respective worm wheels, this object is accomplished in that the nuts are mounted in the machine frame for rotation on vertical axes and the screws carry spherical bearings which are disposed above the nuts and adapted to carry the yoke whereas arcuate guides are omitted.

The yoke member is supported by spherical bearings, which are mounted at the upper end of respective screws and received in depending bearing sockets which are rigid with the yoke, whereas the lower portion of each screw is rotatably mounted in the machine frame in a sleeve bearing assembly and cooperates with drive means. Sets of springs are interposed between the depending sockets and the sleeve bearings mounted on the machine frame and these spring sets eliminate play at the spherical bearings and in the sleeve bearing assemblies during the flattening operation.

Figure 1:
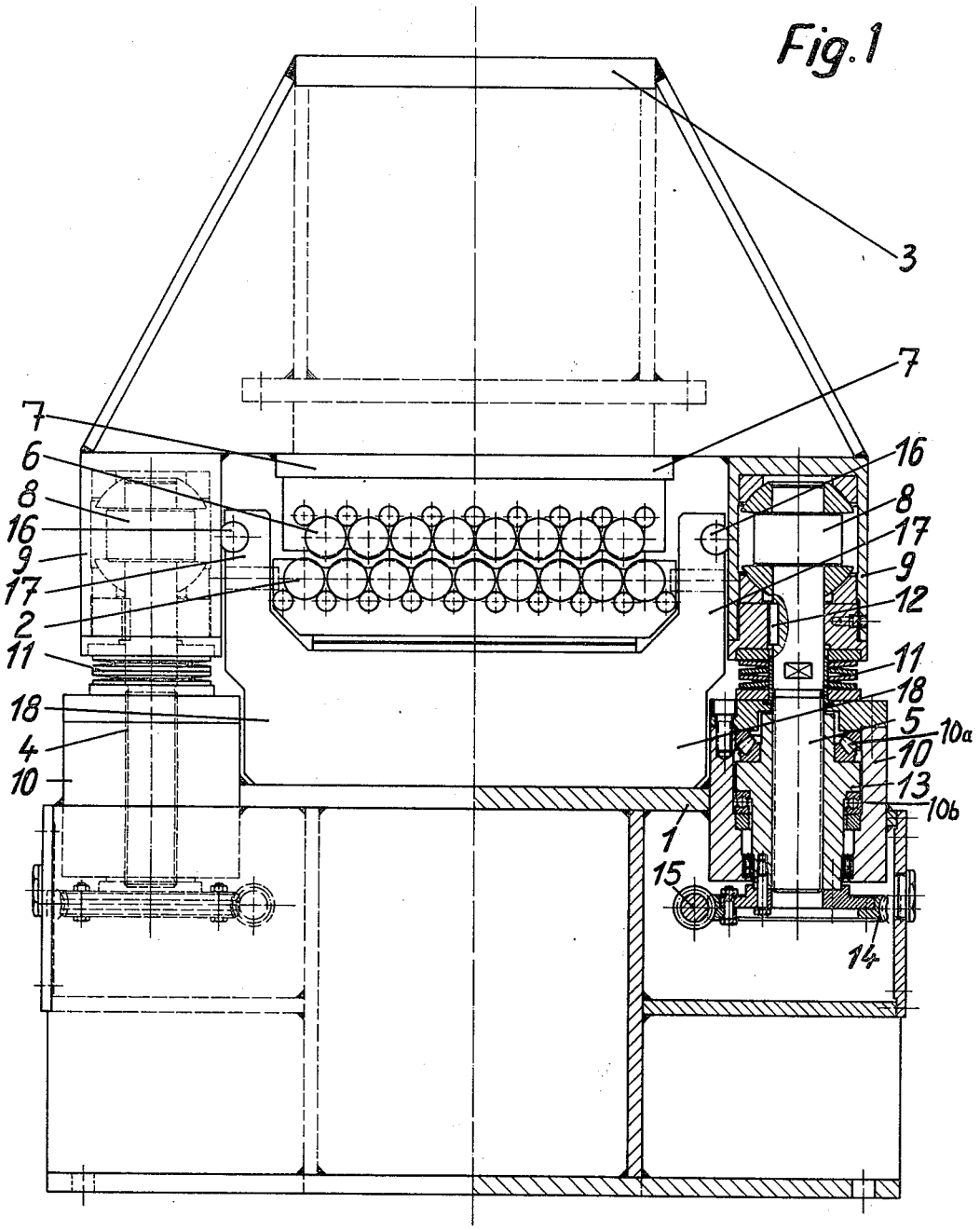
Figure 2:
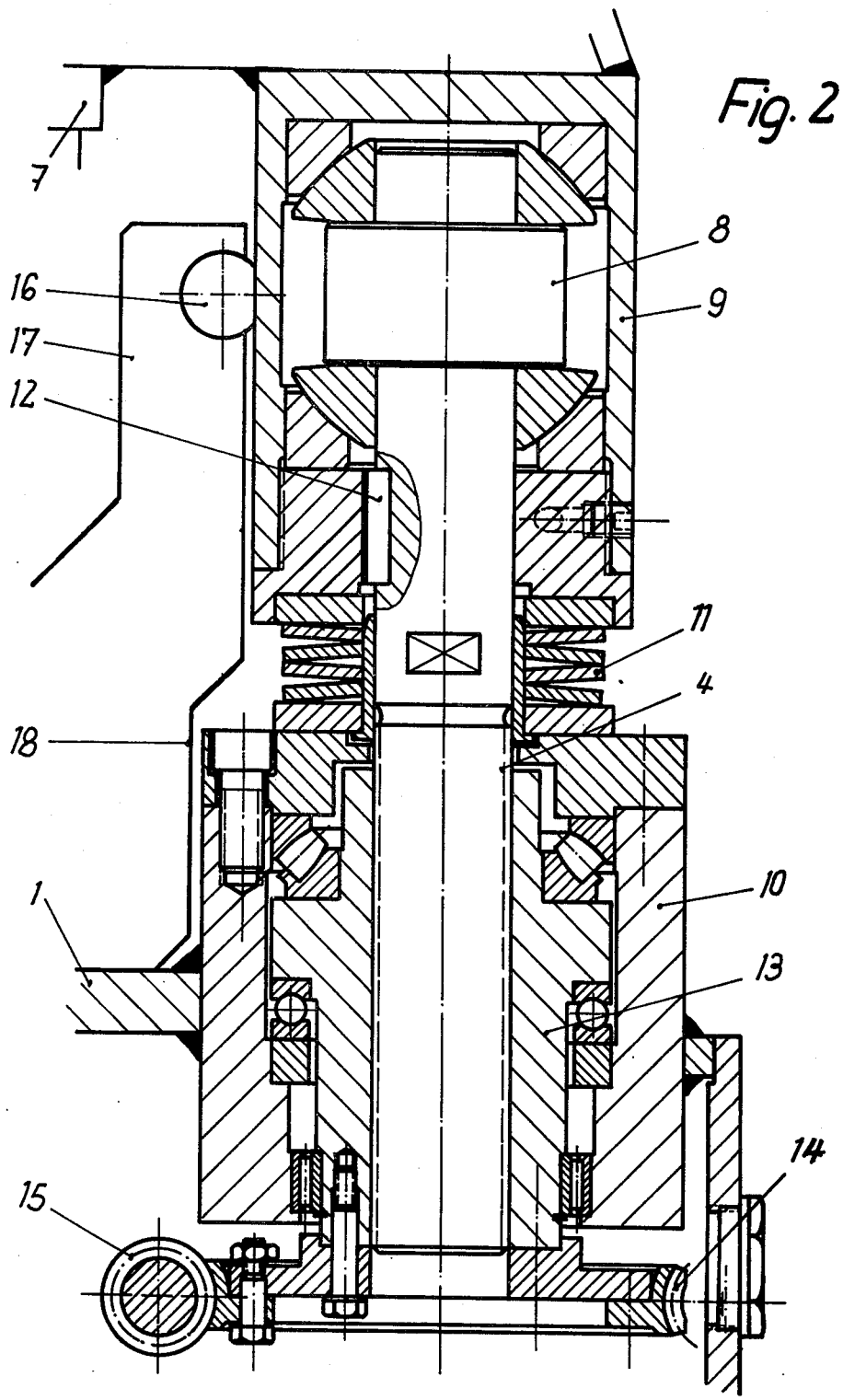
Figure 3:
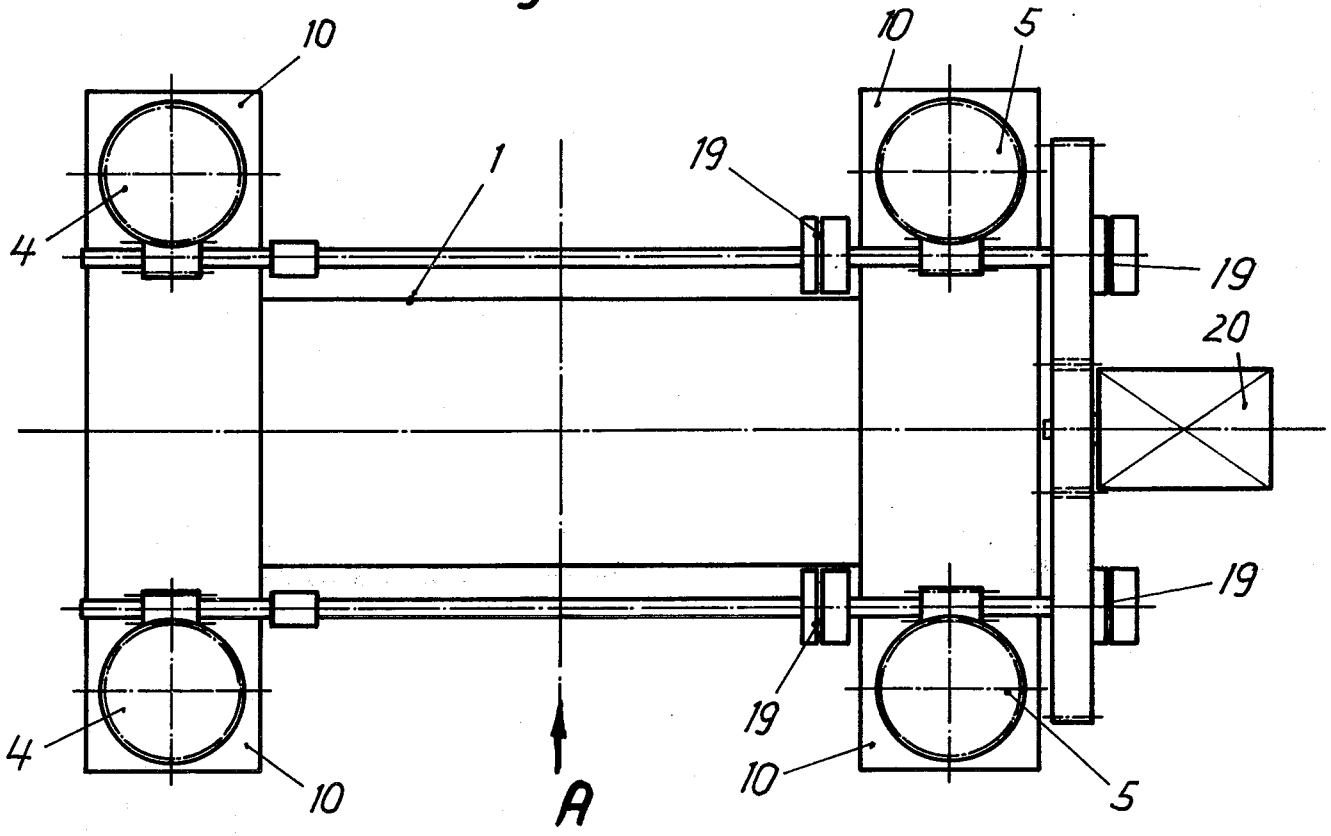

A flattening machine which embodies the present invention and provides for a dual adjustment and comprises spherical bearings is shown by way of example on the drawing, in which FIG. 1 is a side elevation showing a flattening machine according to the invention, partly in section, FIG. 2 is an enlarged fragmentary view showing spherical bearings mounted on a screw in the machine frame and serving to support a yoke, and FIG. 3 is a diagrammatic top plan view showing the drive means for actuating both pairs of screws.

As is apparent from FIGS. 1 and 2 of the drawings, stationary lower rolls 2 are mounted in the bed of a machine frame 1. An upper yoke assembly comprising a crosshead 3 and a yoke member 7 carrying upper rolls 6 is adjustably mounted on pairs of screws 4, 5, which are arranged to be stressed in tension during the flattening operation. The lower portion of each tension screw 4, 5 is adjustably mounted in a sleeve bearing assembly 10, which is carried by the machine frame 1. The yoke member 7 carrying the upper rolls 6 is adjustably supported by spherical bearings 8, which are mounted on the screws 4, 5 and received in depending sockets 9 of the yoke member 7. Each of the tension screws 4, 5 is longitudinally guided in the respective depending socket 9 by a tongue-and-groove joint 12 provided between the screw and the socket and is vertically adjustable relative to the machine frame 1 in the associated sleeve bearing assembly 10 by means of a nut 13, which is mounted by means of an upper rolling element bearing 10 a and a lower rolling element bearing 10 b and connected to a worm wheel 14, which cooperates with a worm shaft 15. The latter is operable at its free end to adjust the screw. Spring sets 11 are interposed between the depending sockets 9 and the sleeve bearing assemblies 10 and serve to eliminate play at the spherical bearings 8 and between the nuts 13 and the sleeve bearing assemblies 10 during the flattening operation.

The depending sockets 9 are rigid with the yoke member 7 and in slidable engagement with flat surfaces of rotatably mounted in uprights 17 of a lower yoke 18, which is supported by the machine frame 1. It is apparent that the flattened rollers 16 are disposed in the center plane of the upper rolls so that the displacement of the yoke member 7 during a tilting thereof is minimized and there is no need for an arcuate guide. The uprights 17 which are rigid with the lower yoke 18 cooperate with the latter to hold the lower rolls 2 in a stationary position.

FIG. 3 is a top plan view showing the means for driving the pairs of screws 4, 5 which are rotatably mounted in the machine frame 1 in sleeve bearing assemblies 10. Each of the screws 4, 5 is adapted to be connected to a drive unit 20 by a clutch 19 so that the screws 4, 5 controlling the position of the upper yoke member 7 and upper rolls 6 may be adjusted in unison (all screws 4 and 5) or only the screws on one side of the strip or the other (screws 4 of screws 5) are adjusted in unison, or only one pair of screws which are aligned transversely to the direction of travel of the strip are adjusted in unison. The direction of travel of the strip is indicated by the arrow A.

What is claimed is:

1. A machine for flattening sheet metal, comprising a machine frame, a plurality of horizontal lower rolls rotatably mounted in said machine frame, a plurality of nuts which are carried by said machine frame and axially retained and are rotatable on respective vertical axes, which are horizontally spaced apart in the longitudinal direction of said lower rolls and in a direction which is transverse to said longitudinal direction, a plurality of screws, which are in threaded engagement with respective ones of said nuts, a plurality of upwardly and downwardly convex spherical bearings carried by respective ones of said screws above said nuts, an upper yoke assembly comprising an upper yoke member, a plurality of upper rolls rotatably mounted in said upper yoke member and disposed above said lower rolls and defining nips therewith, and a plurality of concave spherical bearings which are rigid with said upper yoke member, and each of which has upwardly and downwardly disposed concave bearing faces, which are respectively disposed below and above one of said convex bearings and engageable therewith, spring means urging said upwardly disposed concave bearings upwardly relative to said convex bearings, and actuating means for rotating said nuts relative to said screws.

2. A machine as set forth in claim 1, in which said actuating means are operable to selectively rotate only those of said nuts which are spaced apart in said horizontal direction, only those of said nuts which are spaced apart in said transverse direction, and all of said nuts.

3. A machine as set forth in claim 1, in which each of said nuts is rotatably mounted and axially retained in a sleeve bearing assembly, which is rigid with said machine frame, and each of said concave spherical bearings is contained in a bearing socket, which is rigid with said upper yoke member and depends from said yoke assembly.

4. A machine as set forth in claim 3, in which said spring means comprise compression springs compressed between said sockets and said sleeve bearing assemblies.

5. A machine as set forth in claim 3, in which each of said screws is longitudinally guided in one of said sockets.

6. A machine as set forth in claim 3, in which said actuating means comprise worm wheels which are rigid with respective ones of said nuts and disposed below said sleeve bearing assemblies and worms in mesh with said worm wheels and rotatable to adjust said screws.

7. A machine as set forth in claim 3, in which said upper rolls define a substantially horizontal center plane, said machine frame comprises uprights extending above said center plane and spaced apart in the same directions as said axes and provided with side bearings disposed in said center plane, and each of said side bearings contains a roller, which is rotatably mounted in said side bearing and has a flat, which protrudes from said upright and faces one of said sockets and is in slidable engagement therewith.

8. A machine as set forth in claim 7, in which said machine frame comprises a lower yoke member, which is rigid with said uprights, and said lower rolls are held in position by said lower yoke and uprights.

* * * * *